United States Patent [19]

Graham

[11] Patent Number: 4,643,456

[45] Date of Patent: Feb. 17, 1987

[54] LOCKING THREAD SAVER

[76] Inventor: Albert N. Graham, Rte. 3, Box 233, Hanceville, Ala. 35077

[21] Appl. No.: 777,914

[22] Filed: Sep. 19, 1985

[51] Int. Cl.[4] ..... F16L 35/00

[52] U.S. Cl. ..... 285/18; 285/85; 285/92

[58] Field of Search ..... 285/84, 85, 92, 18; 403/320; 464/24, 26

[56] References Cited

U.S. PATENT DOCUMENTS

| | | | |
|---|---|---|---|
| 903,435 | 11/1908 | Barrott | 403/320 X |
| 1,407,335 | 2/1922 | Reynolds | 285/85 |
| 2,118,350 | 5/1938 | Holt | 285/84 X |
| 2,244,124 | 6/1941 | Shemeley | 285/84 X |

*Primary Examiner*—Dave W. Arola

*Attorney, Agent, or Firm*—Jennings, Carter, Thompson & Veal

[57] ABSTRACT

A locking thread saver for use in connecting a rotatable member such as a length of steel drill pipe to a power transmission utilizes an internally mounted locking plate powered by an internally carried actuator to prevent the premature disengagement of the drill pipe from the transmission when attempting to break the lengths of steel pipe as when the pipe is retracted from a bore hole. The locking member is retained within an internal slot and moves into a cooperative locking position with a slot formed in the end of the drill pipe section connected to the to the thread saver. The locking member may be moved selectively to and from such engaging position to facilitate the removal of the drill pipe section adjacent the thread saver or the removal of a drill pipe section distal the thread saver and connected thereto by an intermediate drill pipe section.

11 Claims, 3 Drawing Figures

LOCKING THREAD SAVER

FIELD OF THE INVENTION

The present invention relates to rotating mechanical apparatus such as drilling apparatus and more particularly relates to a thread saver utilized in such apparatus to connect a length of rotatable members, such as drill pipe sections, to a power transmission in a manner designed to enhance the longevity of the thread life of the connecting threads found on such power transmissions. More particularly the present invention relates to an improved thread saver utilizing an internal locking mechanism to prevent disengagement of the drill pipe section from the thread saver during steel breaking operations while a plurality of lengths of pipe are being removed from a bore hole.

BACKGROUND OF THE INVENTION

Surface mining and other types of geological exploration utilize drilling apparatus to bore holes in the earth's surface. The drilling apparatus employs a plurality of drill pipe sections, normally tubular steel pipe sections, which come in a variety of lengths with a forty-five foot length being somewhat typical. These pipe sections, or drill steels as they are called, are connected one to another by providing cooperating threads at adjacent ends of the pipe sections such that relative rotational movement between the pipe sections causes the pipe sections to become threadedly engaged. The uppermost pipe section on a string of drill steels is attached to the power transmission of the drilling apparatus through a device known as a thread saver which is simply a short length of tubing which is threaded at both ends and serves to protect the threads of the expensive transmission from damage thereby averting costly repairs of the transmission. Typically each drill steel and the thread saver are tubular conduits through which air, water or other fluids may be injected into the bore hole for various purposes, depending on the nature of the drilling operation being carried out.

When the drill string is to be removed from the bore hole the steels are raised and each pipe section must be unthreaded from its subjacent pipe section to facilitate removal. This may be accomplished by engaging the subjacent pipe section with apparatus known as breaking dogs or other devices to arrest rotation of the subjacent pipe section from the uppermost pipe section to be unthreaded while rotating the transmission and the upper pipe section in a direction to unthread the upper pipe section from its subjacent pipe section. Inasmuch as great forces are generated in drilling operations, the threaded connections between the pipe sections are increasingly tightened by the rotation of the drill string in the earth. Consequently the separation of the pipe sections or "breaking" of the steels is not easily accomplished. Inasmuch as the threads connecting the pipe sections to each other and also connecting the thread saver to the upper pipe section must all be inclined in the same direction in order for the string to rotate, it will be seen that arresting rotation of the pipe section subjacent the upper pipe section places the breaking stress on the remaining threaded connections at each end of the upper pipe section, that is at the joint between the thread saver and the upper pipe section and at the joint between the upper pipe section and the pipe section subjacent thereto. Frequently the break occurs at the juncture of the thread saver and the upper pipe section rather than at the juncture of the pipe sections and consequently the removal of the upper pipe section from the string is more complicated inasmuch as the upper pipe section remains securely fastened to the pipe section subjacent thereto and the remaining pipe sections in the ground while being free from the motive force required to rotate the upper pipe section to break its connection to the subjacent pipe section.

When the break occurs at the thread saver the operation of the drilling apparatus comes to a halt until a welder can be brought to the scene to heat the connection between the upper pipe section and the pipe section subjacent thereof in order to expand the metal and thereby decrease the frictional resistance to breaking at this joint in order to improve the likelihood that the break will occur between the pipe sections as desired. Obviously, the mining operations are greatly impeded by this delay. Numerous other methods such as large wrenches which grasp the exterior of the drill steel have been employed in an effort to overcome this problem; however such wrenches are susceptible to contamination by dirt, dust and other foreign matter which is common at the drill site and are therefore considered to be of little use. Also the forces generated on these external devices in attempting to break the steel at these threaded junctions is considerable and presents a safety hazard to any crew members in the proximity of the wrenches while in operation.

When conventional devices are utilized to break a joint in the drill string, the normal procedure is to engage the drill string with the breaking dogs as noted hereinabove and to then rotate the uppermost length of pipe with the transmission. This of course creates great wear and tear on the breaking dogs and consequently requires their frequent replacement which is in and of itself a costly and time-consuming job. Additionally when the breaking dogs engage the lengths of pipe which are rotating it creates great stress on the transmission of the drive units which of course leads to substantial wear and tear particularly when severe impact or shocks occur as are likely to happen in such an operation. Therefore conventional methods of breaking the steel not only are inconvenient in that the steel may break at the wrong junction, they are also harmful to the machinery and serve to shorten the useful life of the transmission and drive apparatus.

SUMMARY OF THE INVENTION

It is the object of this invention to provide a means for selectively locking the thread saver of a drilling apparatus to the subjacent pipe section to prevent separation of such pipe section from the thread saver when breaking the drill string to remove the drill steel therefrom.

Yet another object of the invention is to reduce the frequency of repairs needed for drilling apparatus by reducing the wear and tear associated with removing the drill string from the bore hole.

Another object is to improve the safety in the workplace adjacent the bore hole during the time that the drill string is being removed from the bore hole.

My apparatus accomplishes these and other objects through the advantageous utilization of an improved thread saver which has mounted therein a locking element which is movable axially of the thread saver selectively to engage or disengage the upper length of the drill steel connected thereto to prevent relative rotation of this length of the drill steel and the thread saver thereby causing the steel breaking forces to act at the lower end of the uppermost length of drill steel. The locking element is located inside the bore of the thread saver and is moved by an actuator, also located inside the bore of the thread saver, which is controlled from the exterior of the apparatus such as by a fluid pressure line entering the bore and connected through a fluid swivel joint to allow free rotation of the actuator. The actuator causes the locking member to engage a slot formed in the top of the drill pipe section thereby locking the drill pipe section to the thread saver to prevent relative rotation therebetween.

DESCRIPTION OF THE DRAWING

Apparatus embodying features of my invention is depicted in the accompanying drawings, which form a portion of this application, and wherein.

DESCRIPTION OF A PREFERRED EMBODIMENT

Figure 1:
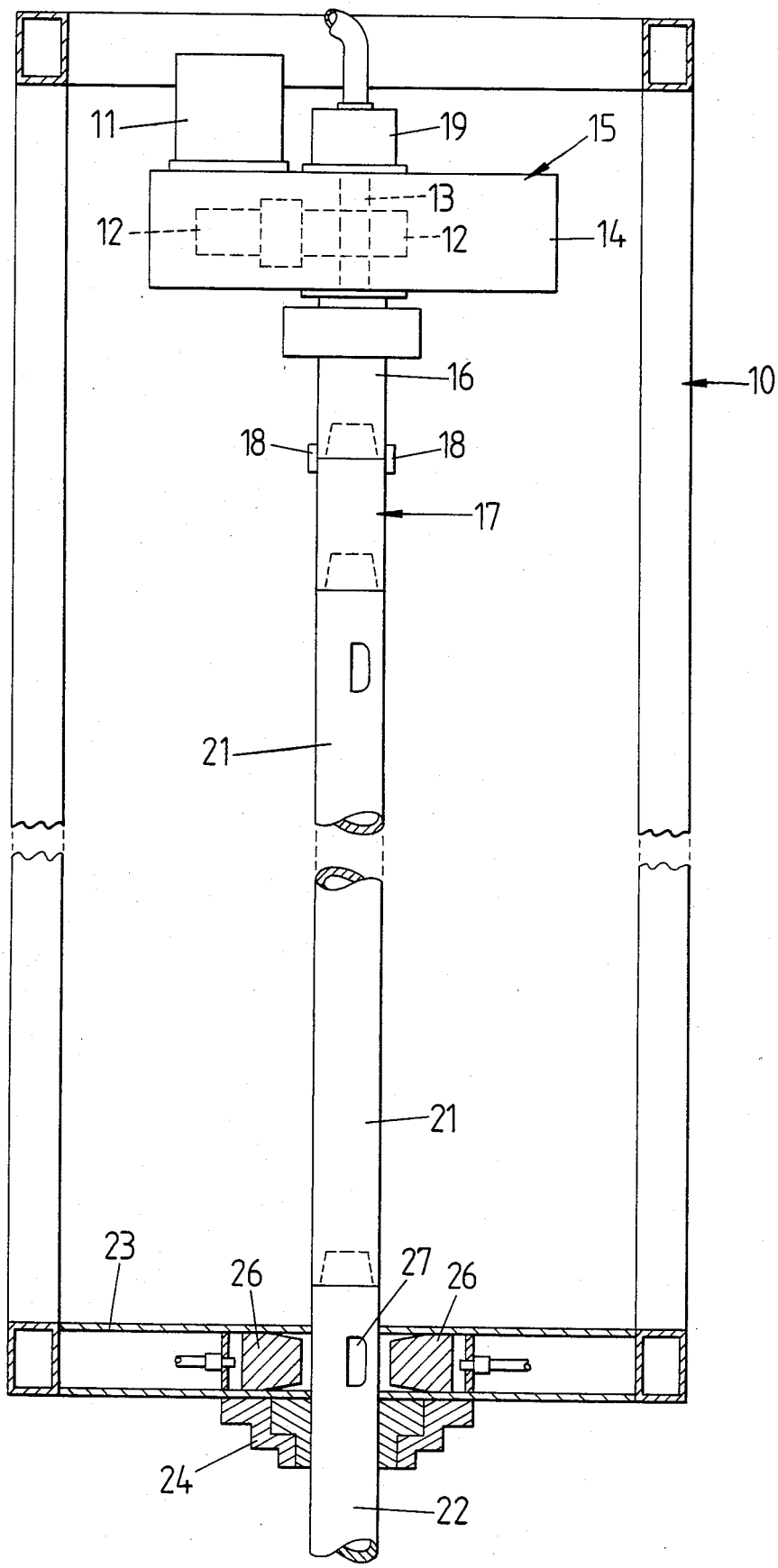
FIG. 1 is an elevational view, partially in section, of a drilling apparatus untilizing my thread saver to connect the transmission to the drill string.

FIG. 1 is an illustration of a portion of a drilling rig such as might be used in surface mining. Mounted for vertical movement within an elongated upstanding frame 10 is a transmission unit 15. The drilling apparatus includes an electric motor 11 which is used conventionally to power the rotation of a plurality of gears 12 which are operatively connected to a drive shaft 13 within a gear box 14 for the transmission unit 15, all of which is supported in a conventional manner, not shown. Above the gear box 14 is a sealed swivel housing 19 through which air or other fluid is introduced to the center of the drive shaft 13. The drive shaft 13 is connected to a shock absorber assembly 16 which terminates in a depending threaded shaft which is connected to and supports the upper end of my thread saver 17. The upper portion of the thread saver may be rigidly attached to the shock absorber assembly 16 as by a pair of welded blocks 18 connecting the shock absorber assembly 16 to the thread saver 17 such that relative rotational motion is prevented between the thread saver 17 and the shock absorber assembly 16; thus the drill string cannot break at the top of the thread saver. The thread saver 17 is threadedly connected to the upper end of a drill pipe section 21 which in turn is connected to a subjacent drill pipe section 22. Such drill pipe sections are commonly referred to as drill steels and when connected together form a drill string which may extend several pipe lengths into the earth with each pipe section being of a suitable length, such as approximately forty-five feet. The upper drill pipe section 21 and the thread saver 17 are both tubular in construction to permit the fluids introduced through the drive shaft 13 to descend to the bottom of the bore hole and exit for various purposes into the space between the drill string and the walls of the bore hole, such as to remove cuttings. The drill string descends through a deck-like structure 23 which carries a table bushing 24 in a manner well known in the art. As shown in FIG. 1, the structure 23 supports a plurality of breaking dogs 26 which are movable radially with respect to the drill pipe section 22 so as to contact the pipe section and engage a set of breaking stops 27, as is well known.

Figure 2:
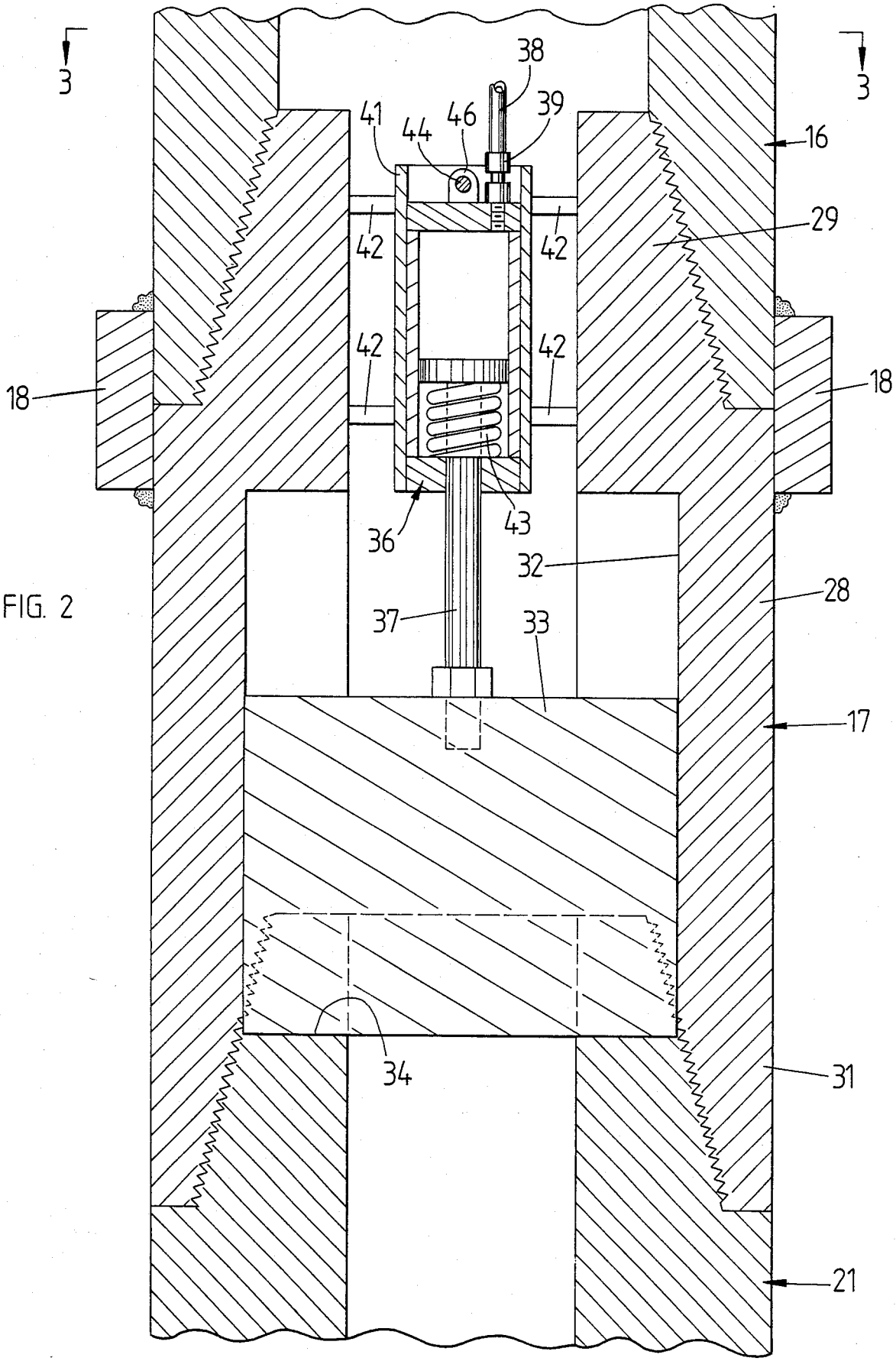
FIG. 2 is an enlarged sectional view of my invention showing the locking plate in the down position; and, FIG. 3 is a sectional view taken along the line 3—3 of FIG. 2.
Figure 3:
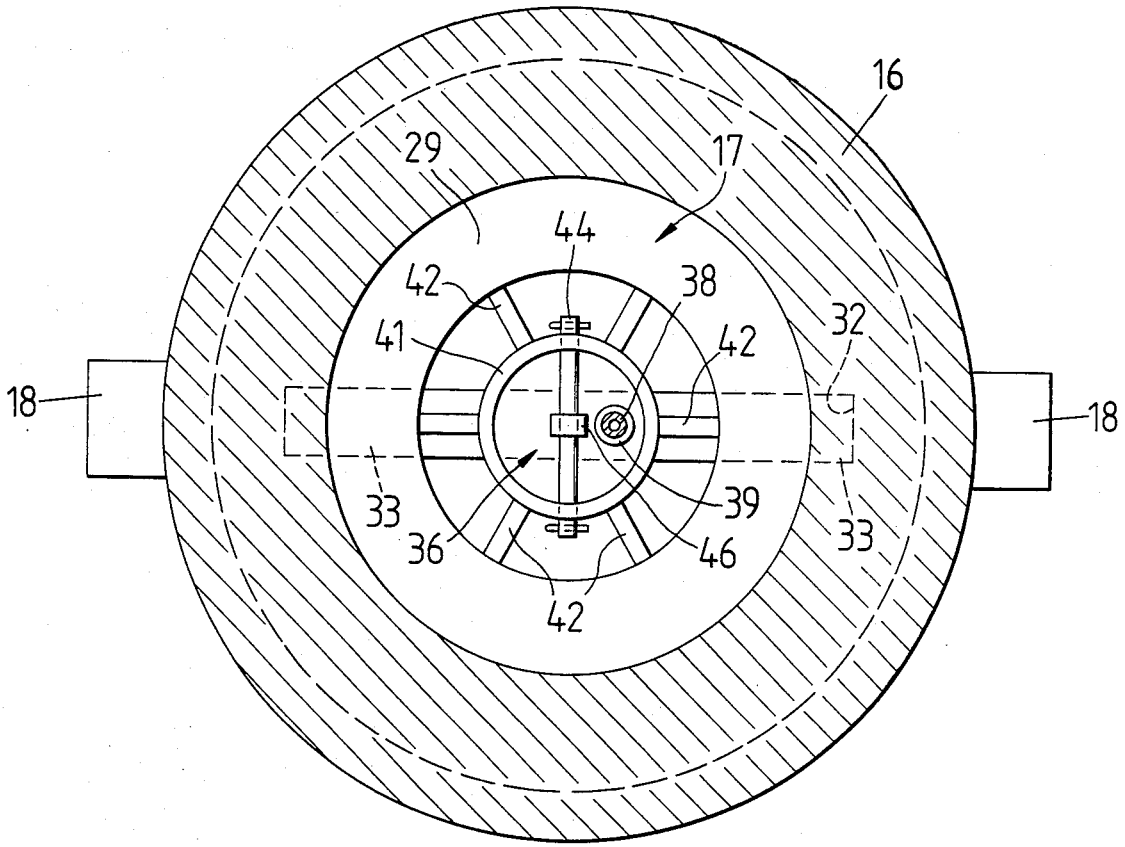

Referring to FIG. 2, the thread saver 17 is essentially a tubular adapter 28 having a tapered upper end 29 which is threaded externally to engage internal threads carried by the lower portion of the shock absorber assembly 16. The lower end 31 of the tubular adapter 28 is internally threaded to receive therewithin external threads carried by the upper end of the drill pipe section 21. An internal transverse slot 32 extends upwardly within the tubular adapter 28 from its lower end 31 in position to define inwardly opening aligned recesses at opposite sides of the vertical bore through the tubular adapter for receiving and retaining therewithin a locking member 33 such as a steel plate. The locking member 33 is free to move longitudinally along the slot 32; however it cannot rotate independently of the tubular adapter 28. The upper end of the drill pipe section 21 and each drill pipe section in the drill string has formed therein a cooperative slot 34 which can be aligned with the transverse slot 32 and which will receive the locking member 33 therewithin in order to lock the drill pipe 21 to the tubular adapter 28.

The locking member 33 is operatively connected to a suitable actuator such as a fluid pressure operated cylinder 36 by a shaft 37 or other suitable connective member interposed between the cylinder and the locking member 33. The cylinder 36 is appropriately sized to fit within the bore of the tubular adapter 28 without substantially interfering with the flow of fluids through the bore and is connected to an external source of fluid under pressure, such as air pressure, by means of a line 38. The line 38, of course, utilizes a swivel 39 of conventional nature to allow the actuator 36 to rotate with the threaded adapter 28 without twisting the line 38. The cylinder 36 is mounted within a cylinder holder 41 which is shown as being in the form of a cylindrical housing mounted to the tubular adapter 28 by a plurality of braces 42. In order to prevent the locking member 33 from inadvertently descending into the cooperative slot 34 the cylinder 36 and consequently the locking member 33 is biased upwards as by a spring 43 cooperatively positioned within the cylinder 36 to urge the locking plate away from the drill pipe section 21. The cylinder 36 is attached to the cylinder holder 41 by means of a pin 44 passing through the holder 41 and an eye 46 extending from the top of the cylinder 36. The pin 44 is held in position by a pair of cotter keys or other suitable conventional fasteners.

In operation the thread saver 17 is threadedly engaged to the shock absorber assembly 16 and welded thereto by the blocks 18. Thereafter the string of drill pipe sections 21 and the subjacent drill pipe sections 22 are sequentially added as the depth of the bore hole increases. When it becomes necessary to separate the drill pipe section 21 from the subjacent drill pipe section 22, such as when the drill pipe sections are being removed from a bore hole, the operator of the drilling apparatus actuates the cylinder 36 from within the control area of the drilling apparatus and causes the locking member 33 to descend into contact with the cooperative slot 34 at the upper end of the drill pipe section. If the cooperative slot 34 is not properly aligned with the slot 32 in the tubular adapter 28 it will become so aligned within 180° of relative rotation between the tubular adapter 28 and the drill pipe section 21 and thereafter the tubular adapter 28 and drill pipe section 21 will be locked together for rotational movement.

The subjacent drill pipe section 22 is engaged by the breaking dogs 26 to resist the rotational movement imparted by the transmission 15 as is well known in the art. However, due to the action of the locking member within the cooperative slot 34 the drill string must break at the juncture of the drill pipe section 21 and the subjacent drill pipe section 22 rather than at the juncture of the tubular adaptor 28 and the drill pipe section 21. After the break is effected between the two sections of drill pipe the locking member 33 can be retracted wtihin the internal transverse slot 32 and the lower end of the drill pipe section 21 can be secured to facilitate the disengagement of the thread saver 17 from the upper end of the drill pipe section 21. It should be noted that the cylinder 36 and the locking member 33 are positioned within the bore of the thread saver 17, yet inasmuch as they do not obstruct the flow of fluids along the bore of the thread saver into the drill pipe sections the ordinary functioning of the interior of the drill string as a conduit for fluids is not in any way hampered by the presence of this improvement to the thread saver.

While I have shown my invention in but one form, it will be obvious to those skilled in the art that it is not so limited, but is susceptible of various changes and modifications without departing from the spirit thereof.

What I claim is:

1. Apparatus for connecting a rotating member such as a drill pipe section to a power transmission, comprising:

(a) a tubular adapter threadedly connected to said rotating member and to said power transmission, with said adapter having a transverse slot formed internally thereof along the bore of said tubular adapter with said slot being aligned with a cooperating slot in said rotating member by a relative rotation of said rotating member with respect to said adapter;

(b) a locking element disposed within said transverse slot in said adapter with said locking element being movable longitudinally within said transverse slot to simultaneously engage said transverse slot and said cooperating slot in said rotatable element; and (c) means, mounted within said tubular adapter, for moving said locking element within said transverse slot.

2. Apparatus for connecting a rotatable element, such as a drill pipe section, to a power transmission comprising in combination:

(a) a tubular adapter threaded at one end for connection to said transmission and threaded at a second end for connection to said rotatable element, and having formed therein a transverse retaining slot extending longitudinally from said second end upwards along the bore of said tubular adapter for a predetermined distance with said rotatable element having a cooperating transverse slot formed in the end thereof proximal said adapter;

(b) means positioned within said retaining slot and movable into engagement with said cooperating transverse slot in said rotatable element for locking said rotatable element to said adapter and movable selectively to an engaged locking position and to a disengaged position; and (c) means positioned within said tubular adapter for moving said means for locking selectively to said engaged position and said disengaged position, with said tubular adapter being substantially unobstructed by means for locking and said means for moving, with said means for moving including biasing means for urging said locking means toward said disengaged position.

3. Apparatus as defined in claim 2 wherein said means for locking comprises a plate-like element positioned within said retaining slot and movable longitudinally along said slot.

4. Apparatus as defined in claim 3 wherein said means for moving comprises a fluid pressure operated cylinder, positioned within said tubular adapter, responsive to control from the exterior of said tubular adapter and operatively connected to said plate-like element to move said element into said engaging position.

5. Apparatus for connecting a rotatable element, such as a drill pipe section, to a power transmission comprising in combination:

(a) a tubular adapter threaded at one end for connection to said transmission and threaded at a second end for connection to said rotatable element;

(b) means positioned within said tubular adapter for locking said rotatable element to said adapter and movable selectively to an engaged locking position and to a disengaged position; and (c) means positioned within said tubular adapter for moving said means for locking selectively to said engaged position and said disengaged position, with said tubular adapter being substantially unobstructed by means for locking and said means for moving, with said means for moving including biasing means for urging said locking means toward said disengaged position and a fluid pressure operated cylinder positioned within said tubular adapter and operatively connected to said means for locking responsive to control from the exterior of said tubular adapter.

6. Apparatus for connecting a rotatable member, such as a drill pipe section, to a power transmission comprising, in combination:

(a) a tubular adapter, threaded at each end to engage said transmission at one end and said rotatable element at a second end;

(b) a plate-like element mounted within said adapter and movable therewithin to a position engaging said rotatable member whereby said rotatable member is constrained to rotate with said adapter; and (c) means positioned within said adapter for moving said plate-like element to and from said engaging position including a fluid pressure operated cylinder operatively connected to said plate-like element, means for attaching said cylinder within said adapter, and means for biasing said plate-like element away from a position engaging said rotatable member.

7. Apparatus as defined in claim 6 wherein said plate-like element is carried within a transverse slot in said adapter and is engaged in said engaging position by a cooperating slot formed in an adjacent end of said rotatable member.

8. Apparatus for connecting a rotating member such as a drill pipe section to a power transmission comprising:

(a) a tubular adapter threadedly connected to said rotating member and to said power transmission, with said adapter having a transverse slot formed internally thereof with said slot being aligned with a cooperating slot in said rotating member by a relative rotation of said rotating member with respect to said adapter;

(b) a locking element disposed within said transverse slot in said adapter with said locking element being movable longitudinally within said transverse slot to simultaneously engage said transverse slot and said cooperating slot in said rotatable element; and (c) means, mounted within said tubular adapter, for moving said locking element within said transverse slot with said means for moving including an actuator responsive to external control and operatively connected to said locking element for moving said element within said slot, a housing containing said actuator operatively mounted within said tubular adapter, and a biasing element connected to said actuator to bias said locking element away from engagement with said cooperating slot.

9. Apparatus as defined in claim 8 wherein said locking element is a steel plate.

10. Apparatus as defined in claim 8 wherein said actuator is a pneumatic cylinder.

11. Apparatus as defined in claim 8 wherein said biasing element is a spring.

* * * * *